US008794817B2

(12) United States Patent
Pearson et al.

(10) Patent No.: US 8,794,817 B2
(45) Date of Patent: Aug. 5, 2014

(54) STRINGED LED CAPSULE LIGHTING APPARATUS

(75) Inventors: Dennis Pearson, Foothill Ranch, CA (US); Wesley Scott Dochnahl, Upland, CA (US); Guang Jin, Santa Monica, CA (US); Jorge Santana, Irvine, CA (US)

(73) Assignee: Tempo Industries, LLC, Irvine, CA (US)

( * ) Notice: Subject to any disclaimer, the term of this patent is extended or adjusted under 35 U.S.C. 154(b) by 178 days.

(21) Appl. No.: 13/533,833

(22) Filed: Jun. 26, 2012

(65) Prior Publication Data

US 2013/0279165 A1 Oct. 24, 2013

Related U.S. Application Data

(60) Provisional application No. 61/637,141, filed on Apr. 23, 2012.

(51) Int. Cl.

| | |
|---|---|
| ***F21V 17/16*** | (2006.01) |
| *F21Y 101/02* | (2006.01) |
| *F21V 21/34* | (2006.01) |

(52) U.S. Cl.

CPC ..... *F21V 17/164* (2013.01); *F21Y 2101/02* (2013.01); *F21V 21/34* (2013.01)

USPC ..... 362/656; 362/235; 362/236; 362/368; 362/640; 362/648

(58) Field of Classification Search

CPC .... F21V 17/164; F21V 21/34; F21Y 2101/02

USPC ..... 362/235, 640, 648, 236, 368, 656

See application file for complete search history.

(56) References Cited

U.S. PATENT DOCUMENTS

| | | | | |
|---|---|---|---|---|
| 4,532,579 | A * | 7/1985 | Merryman | 362/239 |
| 7,080,927 | B2 * | 7/2006 | Feuerborn et al. | 362/368 |
| 7,726,840 | B2 | 6/2010 | Pearson et al. | |
| 7,878,678 | B1 * | 2/2011 | Stamatatos et al. | 362/184 |
| 8,002,426 | B2 | 8/2011 | Pearson et al. | |
| 8,061,870 | B2 | 11/2011 | Pearson et al. | |
| 8,231,261 | B2 * | 7/2012 | Gherardini et al. | 362/647 |
| 8,398,276 | B2 | 3/2013 | Pearson et al. | |
| 2013/0271979 | A1 | 10/2013 | Pearson et al. | |
| 2013/0272000 | A1 | 10/2013 | Pearson et al. | |
| 2013/0279179 | A1 * | 10/2013 | Pearson et al. | 362/364 |

* cited by examiner

*Primary Examiner* — Stephen F Husar
*Assistant Examiner* — James Cranson, Jr.
(74) *Attorney, Agent, or Firm* — Greenberg Traurig LLP; Franklin D. Ubell

(57) ABSTRACT

A plurality of adjacent capsules, each comprising a base component, a body component carrying an LED circuit board, and a lens component, wherein the body and the base snap together and the lens snap-fits to the body. Such capsules are attached to a flexible electrical power cable by electrical connector components internal to the body and which conduct power from the power cable through the body to the LED circuit board.

25 Claims, 9 Drawing Sheets

STRINGED LED CAPSULE LIGHTING APPARATUS

CROSS REFERENCE TO RELATED APPLICATIONS

This application claims the benefit of and priority to U.S. Provisional Application Ser. No. 61/637,141, filed Apr. 23, 2012, entitled "Modular LED Lighting Apparatus," the contents of which is incorporated by reference herein in its entirety.

BACKGROUND

1. Field

The subject disclosure relates to LED lighting apparatus and more particularly to such apparatus providing a string of LED circuit board carrying capsules.

2. Related Art

Various decorative and/or accent linear lighting apparatus such as rope light, luminous incandescent lighting, and festoon lighting have been in use for some time.

SUMMARY

An illustrative stringed LED capsule lighting apparatus comprises a plurality of adjacent capsules, each capsule comprising (a) a base component, (b) a body component carrying an LED circuit board thereon, and (c) a lens component, wherein, in one embodiment, the body and the base snap together, and the lens snap-fits to the body. Electrical conductors for supplying power to the LEDs enter at one end of the body and exit at an opposite end of the body and attach to respective internal metal connector components, which pass through a surface of the body to supply power to one or more LEDs. The electrical connector components may attach to the body, for example, by snapping into the body in an interior portion thereof to thereby hook the capsules to the conductors, thereby forming a flexible string of LED light capsules. In one embodiment, a guide track and means on the capsule bodies for attaching the capsules to the guide track are provided.

DETAILED DESCRIPTION

Figure 1:
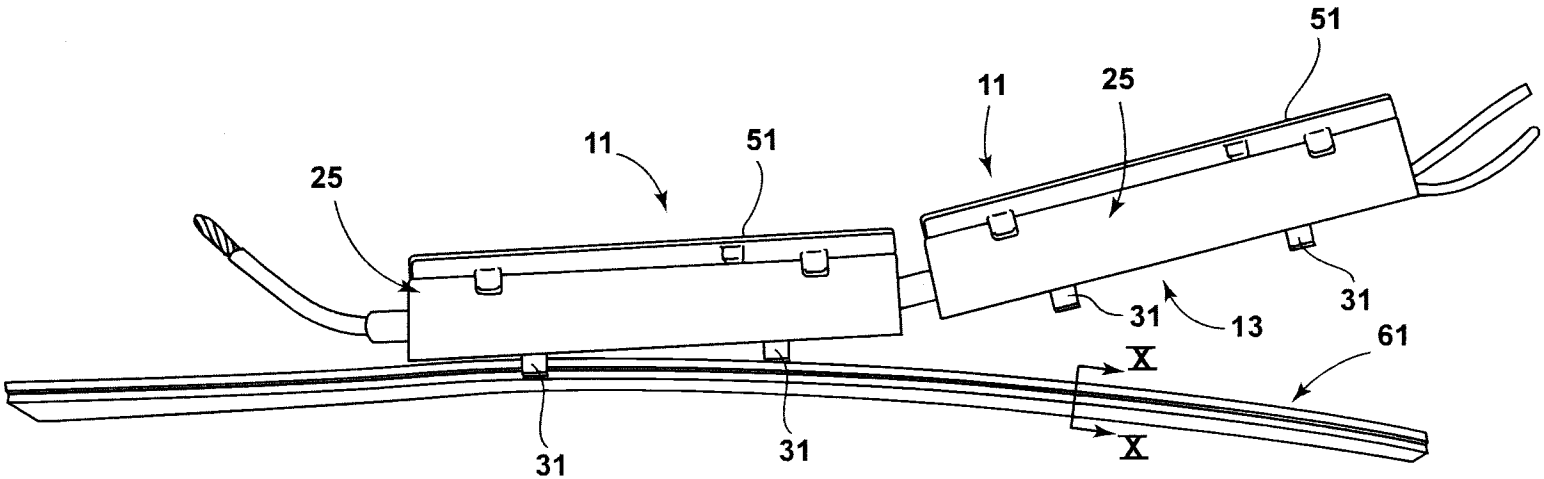
FIG. 1 is a side view illustrating a plurality of LED light capsules and a guide track which may find use therewith.

FIG. 1 shows an illustrative embodiment of a string of LED light modules or "capsules" 11 and a flexible guide track 61 to which the capsules 11 may attach. According to an illustrative embodiment, each LED light capsule 11 comprises a base 13, a body 25, and a lens 51, all three of which may snap together to form the capsule 11.

Figure 2:
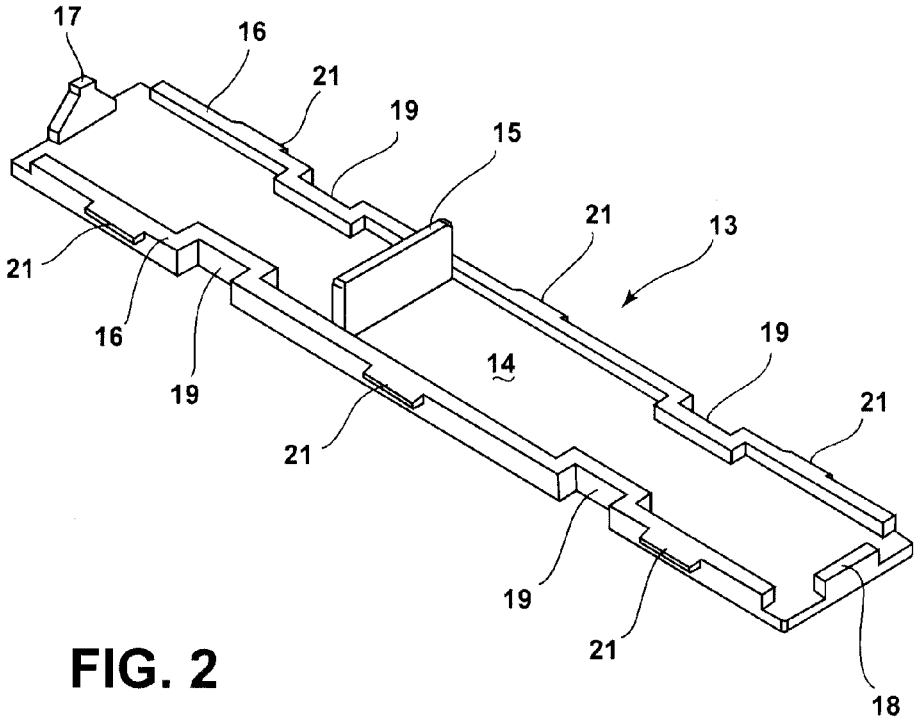
FIG. 2 is a perspective view of a base component of a light capsule.
Figure 3:
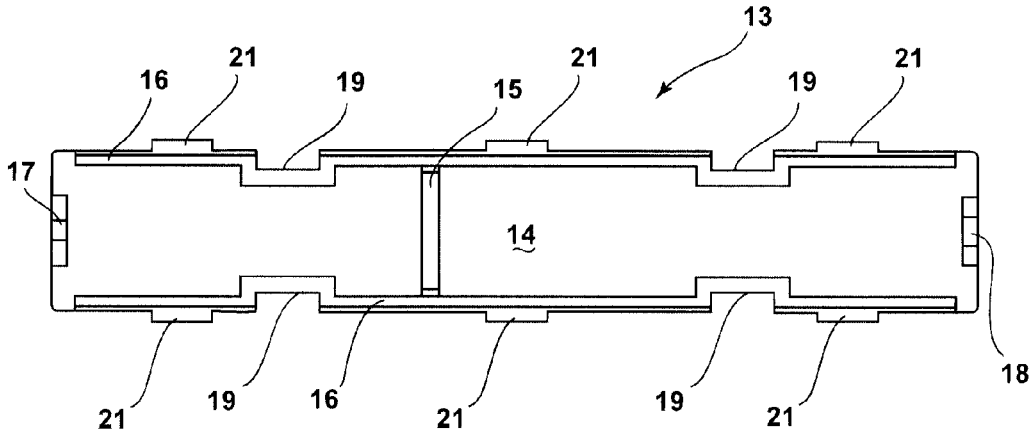
FIG. 3 is a top view of the base component of FIG. 2.
Figure 4:
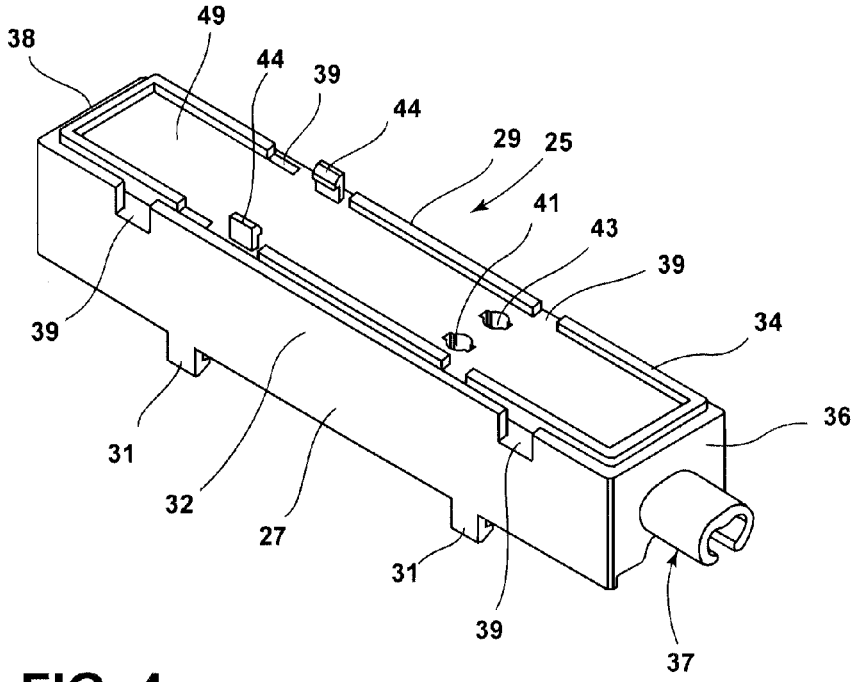
FIG. 4 is a perspective view of a body component of a light capsule.
Figure 7:
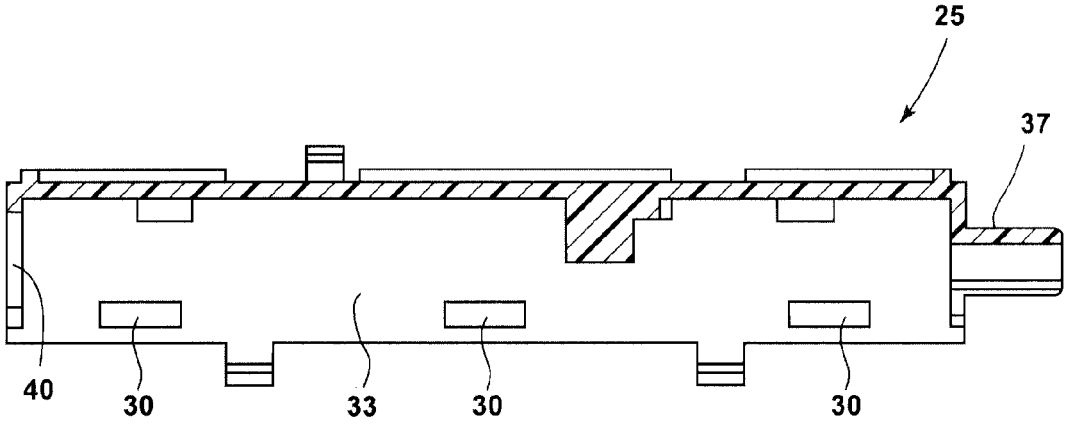
FIG. 7 is a sectional view taken at VII-VII of FIG. 5.

A base member 13 is shown in FIGS. 2-3 and includes a generally flat floor portion 14 from which extends a generally rectangular inner vertical support 15 and respective end supports 17, 18. Along each side of the floor 14 are respective vertical lips 16, indentations 19 in the vertical lips 16, and mounting tabs 21. The indentations 19 allow passage of guide track mounting tabs 31 of the body 25, while the tabs 21 snap into recesses 30 (FIG. 7) in the inner sidewalls 33, 35 of the body 25 to enable the base 13 to snap or press fit to the body 25.

Figure 8:
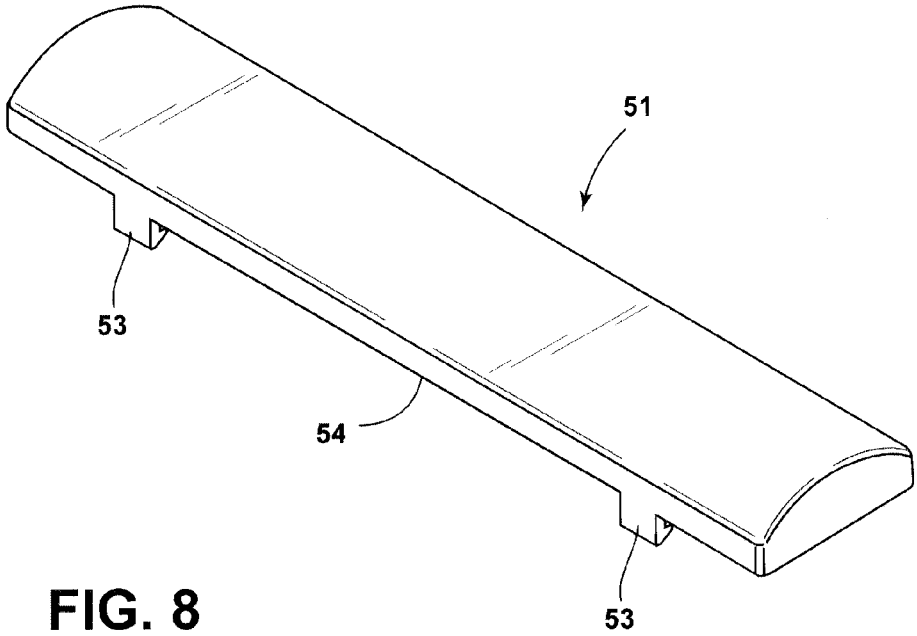
FIG. 8 is a perspective view of a lens component.
Figure 9:
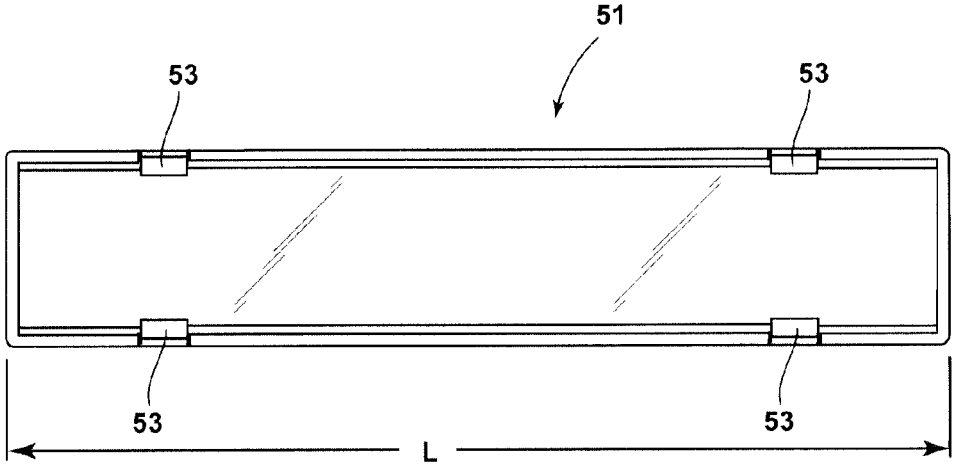
FIG. 9 is a bottom view of the lens component of FIG. 8.

FIGS. 4-7 further show that the body 25 includes vertical side walls 32,34 and front and back walls, 36. 38. A wire guide 37 protrudes from the front wall 36, while an oval opening 40 (FIG. 12) is formed in the back wall 38. The guide track mounting tabs 31 are formed along the bottom edges of the side walls 32, 34, while slots 39 are formed along the top edges. The slots 39 accommodate tabs 53 formed on respective sides of the lower rectangular edge 54 of the lens 51 (FIG. 8) and facilitate snap fitting of the lens 51 onto the body 25. Flexible fingers 44 extend from a top surface 48 of the body 25 and serve to attach an LED-carrying circuit board 115 (FIG. 11) to the surface 48.

Figure 5:
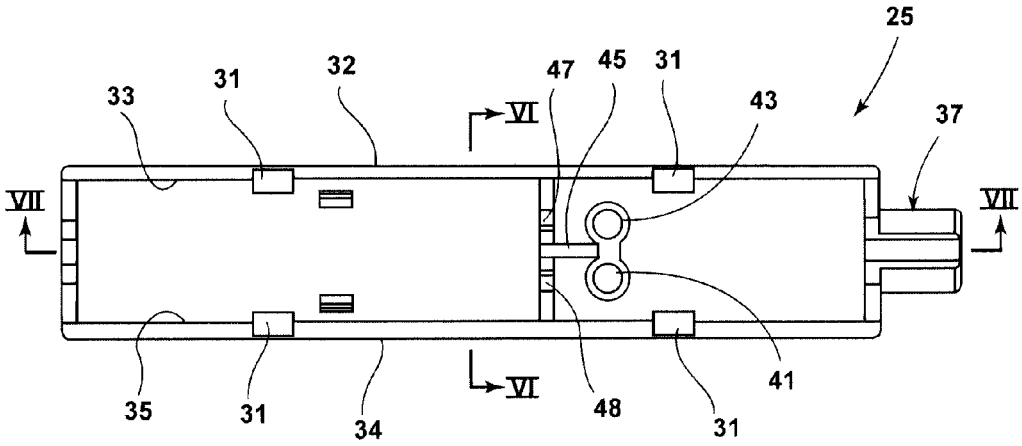
FIG. 5 is a top view of the body component of FIG. 4.
Figure 6:
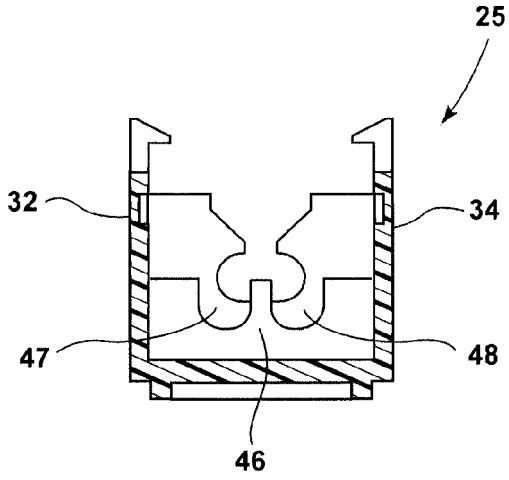
FIG. 6 is a sectional view taken at VI-VI of FIG. 5.

A pair of holes 41, 43 are provided through the top surface 48 of body 25 and facilitate passage of electrical pins 109, 111 (FIG. 11) to supply power to the LEDs, e.g., 112 and related circuitry on the LED carrying circuit board 115. In one embodiment, one or more relatively low power LEDs are employed to achieve various decorative lighting effects. As shown in FIGS. 5 and 6, wire guides are formed on the underside of surface 49, which in the illustrative embodiment include a central vertical guide tab 45 and a horizontal tab 46 with wire guide slots 47 and 48.

Figure 11:
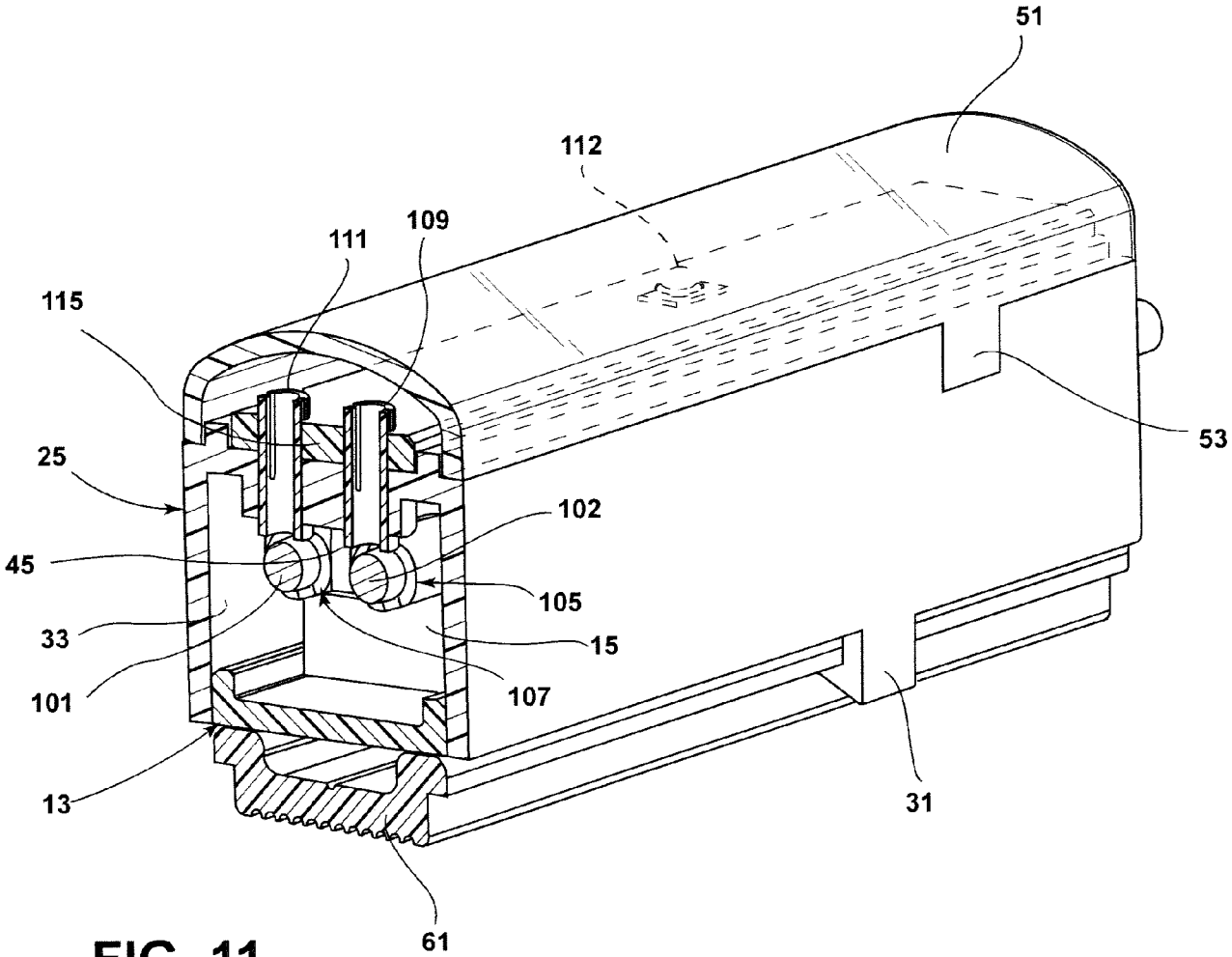
FIG. 11 is a cutaway view of a portion of a light capsule unit illustrating internal electrical conducting componentry.
Figure 12:
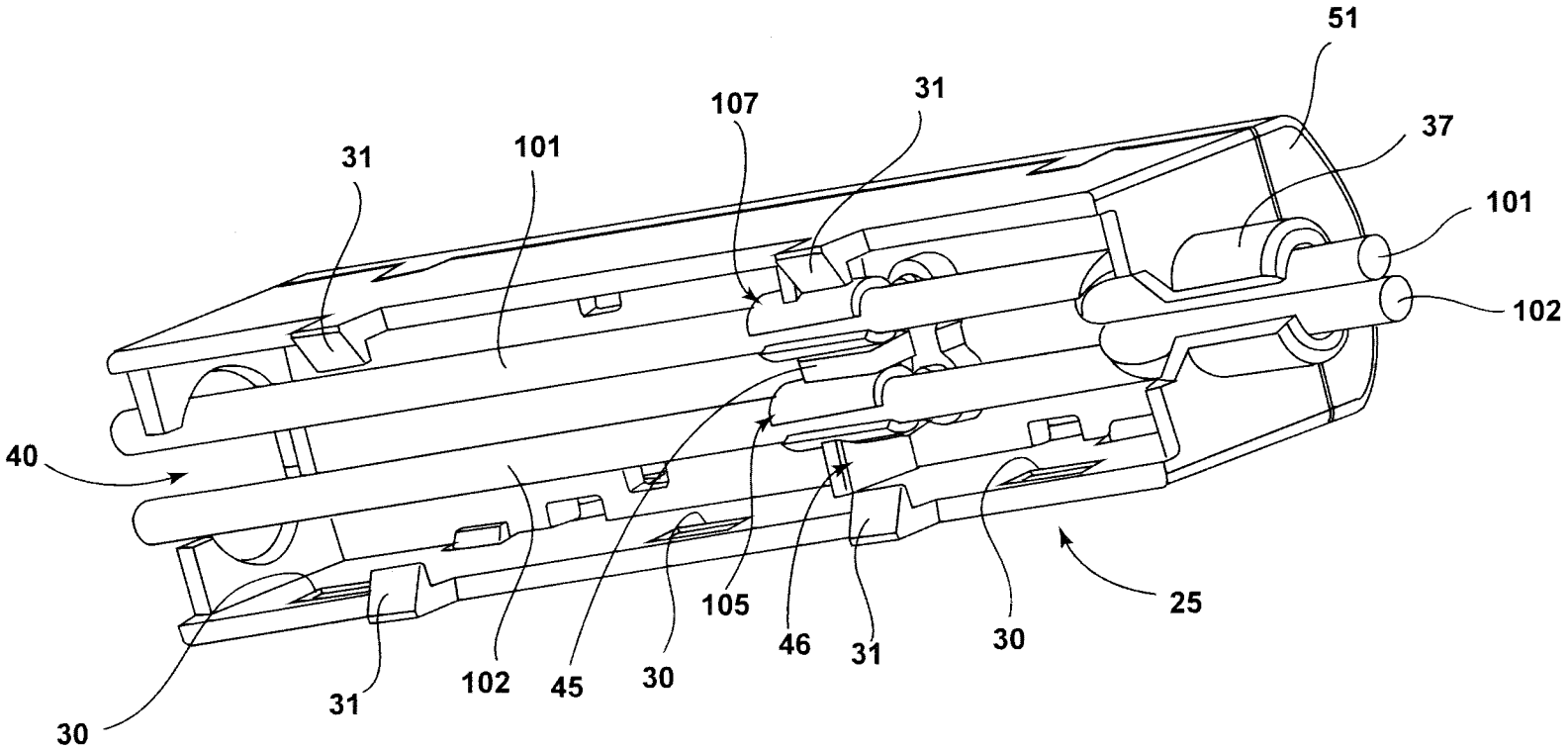
FIG. 12 is a perspective view of the underside of a light capsule unit with the base component removed.
Figure 13:
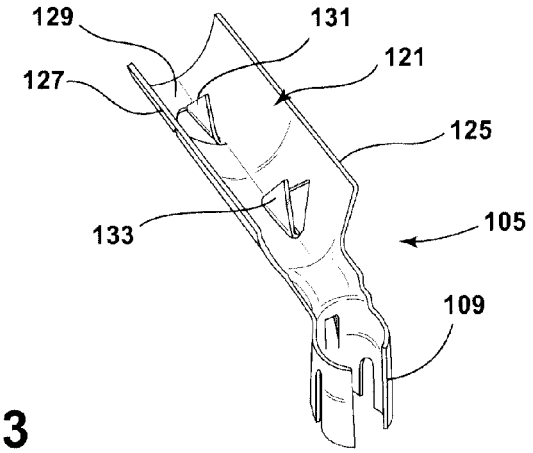
FIG. 13 is a perspective view of an illustrative embodiment of an electrical connector.
Figure 14:
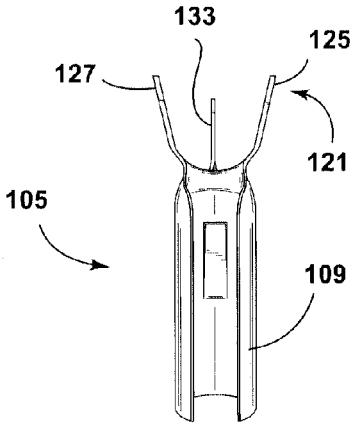
FIG. 14 is an end view of the connector of FIG. 13.
Figure 15:
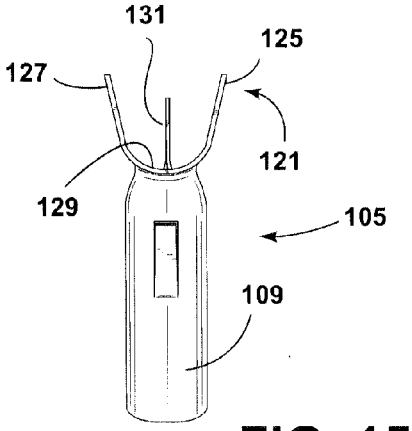
FIG. 15 is an end view of an opposite end of the connector of FIG. 13.
Figure 16:
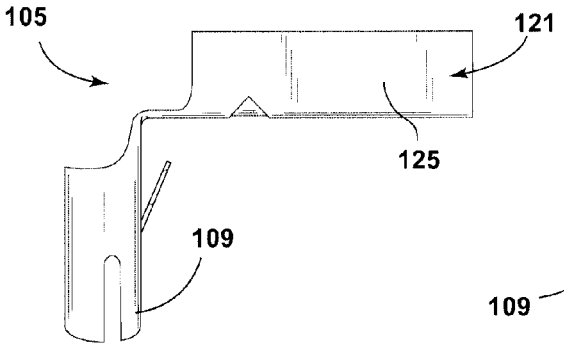
FIG. 16 is a side view of the connector of FIG. 13.
Figure 17:
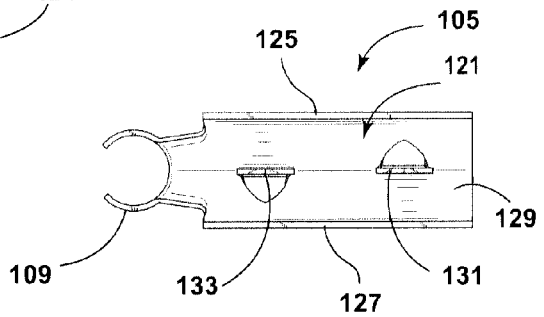
FIG. 17 is a side view of the connector of FIG. 13.

FIGS. 11 and 12 illustrate how the respective electrical conductors (wires) 101,102 are guided through the body and employed to interconnect one adjacent module or capsule 11 to the next. In particular, in one illustrative embodiment, metal connector components 105, 107 are clamped onto the respective wires 101, 102 so as to pierce and make electrical contact with the current carrying electrical conductors inside respective outer insulative layers of the wires 101,102. Additionally, the wired guide 37 captures and holds the electrical cable to further assist in attaching the capsules 11 to the cable.

Figure 10:
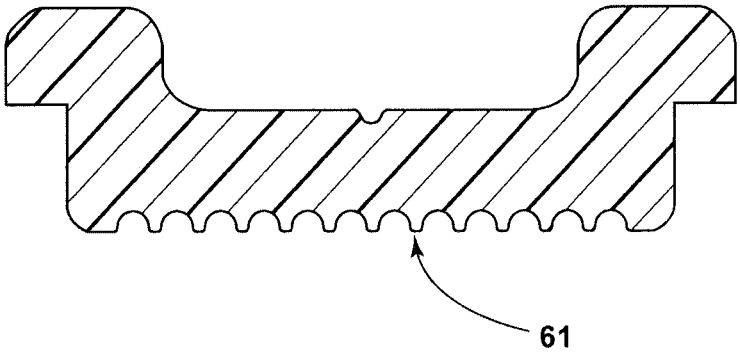
FIG. 10 is a sectional view of an illustrative guide track taken at X-X of FIG. 1.

As noted above, the connector components 105, 107 include the vertically extending pins 109, 111, which carry power to the circuit board 115. As may be seen in FIG. 12, respective cylindrical portions of the connector components 105, 107 snap into or otherwise attach to the respective wire guide slots 47, 48 and are separated by the central vertical guide tab 45. The conductors 101, 102 are guided out of the body 25 at one end by the wire guide 37, which, in an illustrative embodiment, extends into the oval opening 40 of an adjacent capsule 11 and is shaped and sized to be pivotable or rotatable therein to guide and shield the conductors 101,102, while at the same time allowing each module or capsule 11 in a string of modules or capsules to freely bend in any direction and to provide decorative "string lighting" effects. In one embodiment, strings of modules can be removably attached to a guide track 61, which may be stapled to adjacent surfaces and optionally also glued, employing the teeth on the underside of the guide track (FIG. 10) which serve to provide more surface area to promote adhesion. The flexibility of the guide track 61 may also vary in various embodiments.

An illustrative embodiment of a connector 105 is shown in more detail in FIGS. 13-17. The connector 105 includes a horizontal channel 121 which unitarily forms or bends into a vertically disposed pin 109. The channel 121 includes respective sides 125, 127, which extend on either side of an arcuate bottom portion 129. First and second teeth 131, 133 protrude upwardly from the bottom portion 129. In one embodiment, the second connector 107 may be identical to connector 105. Connectors so constructed may be readily attached to insulated electrical conductors or cable utilizing a machine which pushes the teeth 131, 133 through the insulation and into the electrically conductive portion as the sides 125, 127 are crimped around the cable.

Various embodiments may provide low-profile (¾" H×⅝" W), dimmable high-performance, LED articulated accent lighting and may employ Class I or Class II low voltage (12V) transformers. Illustrative embodiments may further comprise a series of low-voltage LED capsules directly attached to a flexible wire harness. Such embodiments can conform to a radius as small as six-inches, allowing attachment to inside and outside curves in a multitude of interior and exterior applications, and in one embodiment, employing lighting-class LEDs, of, for example, 40 to 80 milliamps with 3 LEDs per board 115. Runs of 30 feet, and optionally 60 feet, are available according to various embodiments. In one embodiment, the length "L" of the lens 51, may be 3.0 inches, but of course may vary in other embodiments.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. A lighting apparatus comprising:

a plurality of adjacent capsules each comprising:

a base;

a body carrying a circuit board thereon, each circuit board carrying one or more LEDs; and a lens;

wherein the body and the base of each respective capsule snap-fit together and wherein the lens of each capsule snap-fits to its respective body;

wherein at least first and second electrical conductors for supplying power to the one or more LEDs enter at one end of each capsule and exit at an opposite end of each capsule;

the at least first and second electrical conductors being attached to respective electrical connector components in the interior of each capsule, the respective electrical connector components passing through a surface of the respective body to supply power to the one or more LEDs; and wherein the respective electrical connector components removably attach to the body in an interior portion thereof, each capsule being strung together with an adjacent capsule by said at least first and second electrical conductors.

2. The apparatus of claim 1 further comprising a guide track and further including means for attaching each of a plurality of said capsules to the guide track.

3. The apparatus of claim 1 further comprising a guide track and wherein the guide track and a plurality of said capsules are configured to snap fit together.

4. The lighting apparatus of claim 1 wherein the respective electrical connector components snap-fit into each body.

5. The lighting apparatus of claim 1 wherein each base comprises a generally flat floor from which extends a generally rectangular inner vertical support and respective first and second vertical end supports.

6. The lighting apparatus of claim 5 wherein said floor has first and second vertical lips formed on opposite sides thereof with a plurality of indentations formed therein, the indentations being configured to allow passage of respective mounting tabs formed on each said body, each of the first and second vertical lips further having respective horizontal tabs extending therefrom and positioned to enter respective recesses in respective sidewalls of a respective body.

7. The lighting apparatus of claim 6 wherein each horizontal tab is configured to snap or press-fit into its respective recess.

8. The lighting apparatus of claim 1 wherein each body comprises first and second vertical side walls; a front wall; and a back wall, the front and back walls each having an opening formed therein.

9. The lighting apparatus of claim 8 wherein each body further comprises respective mounting tabs formed on respective first and second bottom edges of the side walls and slots formed along respective first and second top edges of the sidewalls; wherein the slots are positioned to receive respective tabs formed on respective sides of a lower rectangular edge of a lens.

10. The lighting apparatus of claim 9 wherein the tabs formed on the lower edge of each lens are configured to enable the lens to snap fit onto a respective body.

11. The lighting apparatus of claim 10 wherein a plurality of flexible fingers extend from a top surface of each body and serve to attach a respective LED-carrying circuit board to said surface.

12. The lighting apparatus of claim 1 wherein each body includes first and second wire guide slots formed in the interior thereof for removably receiving a respective one of said electrical connector components.

13. The lighting apparatus of claim 12 further comprising a central vertical tab separating the respective electrical connector components.

14. The lighting apparatus of claim 13 further comprising a wire guide formed at one end of the body configured to capture and hold said first and second electrical conductors.

15. The lighting apparatus of claim 14 wherein the wire guide is configured to extend into an opening of an adjacent capsule and is shaped and sized to be pivotable or rotatable when positioned in said opening.

16. The lighting apparatus of claim 12 wherein a respective electrical connector component snap-fits or press-fits into, or otherwise removably attaches to, a respective wire guide slot.

17. The apparatus of claim 1 further comprising a guide track and wherein said guide track and a plurality of said capsules are configured to attach together.

18. The apparatus of claim 17 wherein the attachment between said guide track and said plurality of said capsules is a removable attachment.

19. A lighting apparatus comprising:

a plurality of adjacent capsules each comprising:

a base;

a body carrying a circuit board thereon, each circuit board carrying one or more LEDs; and a lens;

wherein the body and the base of each respective capsule removably attach together and wherein the lens of each capsule removably attaches to its respective body; and at least a pair of electrical conductors being attached to respective electrical connector components in the interior of each capsule, the respective electrical connector components passing through a surface of the respective body to supply power to the one or more LEDs;

each capsule being strung together with an adjacent capsule by a plurality of electrical conductors disposed between them.

20. The lighting apparatus of claim 19 wherein said plurality of electrical conductors comprise a first wire and a second wire, the first and second wires entering a first body, passing through the first body, and exiting the first body and then entering a second body, passing through the second body and exiting the second body.

21. The apparatus of claim 19 further comprising a guide track and further including means for attaching each of a plurality of said capsules to the guide track,

22. The apparatus of claim 19 further comprising a guide track and wherein the guide track and a plurality of said capsules are configured to snap-fit together.

23. The lighting apparatus of claim 19 Wherein the respective electrical connector components snap-fit into each body.

24. The apparatus of claim 19 further comprising a guide track and wherein said guide track and a plurality of said capsules are configured to attach together.

25. The apparatus of claim 24 wherein the attachment between said guide track and said plurality of said capsules is a removable attachment.

* * * * *